US008966804B2

(12) United States Patent
Kay

(10) Patent No.: US 8,966,804 B2
(45) **Date of Patent: *Mar. 3, 2015**

(54) REMOVABLE FLASHLIGHT BODY OR STORAGE CONTAINER FOR A FIREARM

(71) Applicant: Ira Kay, Warrenton, VA (US)

(72) Inventor: Ira Kay, Warrenton, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/222,600

(22) Filed: Mar. 22, 2014

(65) Prior Publication Data

US 2014/0204566 A1 Jul. 24, 2014

Related U.S. Application Data

(63) Continuation of application No. 11/339,138, filed on Jan. 25, 2006, now Pat. No. 8,806,795.

(60) Provisional application No. 60/647,024, filed on Jan. 27, 2005.

(51) Int. Cl.
*F41C 27/00* (2006.01)
*F41G 11/00* (2006.01)

(52) U.S. Cl.
CPC ..... *F41G 11/003* (2013.01)
USPC ..... 42/90; 42/146

(58) Field of Classification Search
USPC ..... 42/90, 146
See application file for complete search history.

(56) References Cited

U.S. PATENT DOCUMENTS 4,501,071 A 2/1985 Manske
4,707,772 A 11/1987 Jimenez et al.
4,777,754 A 10/1988 Reynolds, Jr.
5,040,322 A 8/1991 Iturrey, Jr.
5,430,967 A 7/1995 Woodman et al.
5,555,662 A 9/1996 Teetzel
5,584,137 A 12/1996 Teetzel
5,727,346 A 3/1998 Lazzarini et al.
5,816,683 A 10/1998 Christiansen
5,822,905 A 10/1998 Teetzel
5,941,489 A 8/1999 Fanelli et al.
6,318,014 B1 11/2001 Porter
6,438,888 B1 8/2002 Lin et al.
6,565,226 B1 5/2003 Cummings
6,574,901 B1 6/2003 Solinsky et al.
6,623,140 B2 9/2003 Watterson et al.
6,851,214 B2 2/2005 Oz
7,305,790 B2 12/2007 Kay
2001/0027620 A1 10/2001 Wooten et al.
2001/0045046 A1 11/2001 Otteman
2002/0007581 A1 1/2002 Bucciarelli et al.
2002/0100204 A1 8/2002 Kim
2005/0128741 A1 6/2005 Matthews et al.
2005/0246936 A1 11/2005 Kay

*Primary Examiner* — Michelle Clement
(74) *Attorney, Agent, or Firm* — Shlesinger, Arkwright & Garvey LLP

(57) ABSTRACT

Device for removable attachment to a mounting rail including a body having first and second lateral members movable along respective first and second slots between a retracted position and an extended position; the first and second lateral members in the extended position include portions extending beyond the body for attachment to the mounting rail; a first lock to lock the first and second lateral members in the extended position with third and fourth lateral members depressible into respective third and fourth slots in the body when the first and second lateral members are in the retracted position and having respective bottom portions that engage respective top edge portions of the first and second lateral members when in the extended position; first and second springs to outwardly bias the respective third and fourth lateral members; and a second lock to prevent longitudinal movement of the body on the mounting rail.

16 Claims, 8 Drawing Sheets

REMOVABLE FLASHLIGHT BODY OR STORAGE CONTAINER FOR A FIREARM

RELATED APPLICATIONS

This is a continuation of application Ser. No. 11/339,138, filed Jan. 25, 2006, hereby incorporated by reference, which claims the priority benefit of provisional application Ser. No. 60/647,024, filed Jan. 27, 2005, hereby incorporated by reference.

FIELD OF INVENTION

The present invention relates generally to the field of firearms, and more particularly, to the field of storage devices, as it concerns a container of a predefined shape that can form its own attachment interface for mounting to a predetermined configuration of firearm mounting rail.

The present invention permits the storage container to be used by itself as a standalone device or, in combination with a mounting rail that may be attached to a firearm or other device. Additionally the storage housing can be part of any device whose other components are compatible with it.

BACKGROUND OF THE INVENTION

Most accessory storage containers for firearms do not have the capability to readily mount and dismount from a firearm. There have been components of firearms, such as butt stock, and pistol grip assemblies that have contained internal storage compartments. However these compartments are not readily removable from the firearm for separate portability. Additionally these containers if removed from the firearm will generally render the firearm unserviceable. Most accessory devices that attach to a firearm rail use various forms of clamping mechanisms to attach, and generally require the use of tools. Additionally these accessories, whether they are storage containers or associated devices are unable to assume a predefined shape of a standalone configuration where the attachment mechanism is not readily apparent. A storage container of a pre-defined shape with a hidden attachment apparatus for mounting to firearm accessory rail has been lacking from prior art.

Within the field of firearms there have been various accessories which can be mounted to specific firearms. Most of these systems use locking and clamping devices that either require the use of tools, are difficult or impossible to attach or detach with one hand, or have firearm specific interfaces.

Other prior art documents also present very different attachment methodology or are specific to firearms that do not have a standard rail mount, and cannot alternate from a predefined shape to a mounted configuration:

U.S. Pub. No. US 2005/0246936 A1 to Ira M. Kay (Filed Apr. 1, 2004) discloses a flashlight assembly with a predefined shape that has extendable and retractable lateral members for attachment to a guide. A positive lateral member locking device in the extended position is not provided, nor is a dovetail track for the lateral members to travel through that gives maximum stability to the lateral members through maximum engagement. Additionally the use of the housing assembly is only in combination with components consistent with an illumination device.

U.S. Pat. No. 5,584,137 to James W. Teetzel (Dec. 17, 1996) discloses a mounting interface that is attached to a firearm that in turn becomes the mounting rail for an accessory with a non-standard mount.

U.S. Pat. No. 5,430,967 to Woodman et al. (Jul. 11, 1995) discloses a dedicated illumination device that is specific to a proprietary closed rail design. This device cannot mount to various firearms using a standard rail mount.

U.S. Pat. No. 6,565,226 to Thomas Allen Cummings (May 20, 2003) discloses a mount that can be attached to a shotgun, which in turn can act as a mounting clamp for a flashlight.

U.S. Pat. No. 5,941,489 to Fanelli et al. (Aug. 24, 1999) discloses a firearm mount that can attach to standard rail mount using hand tightened thumbnuts, so that it can receive a device that itself has a rail attachment mount as either part of the device, or as an intermediary component.

U.S. Pat. No. 5,727,346 to Lazzarini et al. (Mar. 17, 1998) discloses a mount that can be attached to a shotgun component through modification to the host firearm, and then it in turn can receive a handheld flashlight.

U.S. Pat. No. 6,574,901 to Solinsky et al. (Jun. 10, 2003) discloses a flashlight with a deployed rail mount that is a part of the unit; which cannot be hidden from view.

A storage container with a hidden integral mounting apparatus that can transition between an independent device and a device mounted to a firearm or other device has largely been unaddressed heretofore.

OBJECTS AND ADVANTAGES

The storage container according to the invention is extremely versatile, and can be mounted on any firearm or device that has a mounting rail affixed to it, and can be readily attached and detached, and transition between a handheld device with no visible rail mount and a storage container with a deployed rail mount.

Accordingly, several objects and advantages of my invention are to provide a storage container that can be mounted on any firearm or device that has a mounting rail affixed to it, and can be readily attached and detached, and transition between a handheld device with no readily visible rail mount and a storage container with a deployed rail mount. The storage container housing is extremely versatile, and can be used for storage or in combination with other devices, such as illumination and communication that can take advantage of the readily available mounting system that is contained within the pre-defined shape of the storage housing. The storage container can be attached to a mounting rail without the use of tools, and with one hand.

Still further objects and advantages will become apparent from a consideration of the ensuing description and accompanying drawings.

SUMMARY OF THE INVENTION

An object of the present invention is to provide a removable storage container, that can be readily mounted on a firearm and in turn be readily removable from the firearm while returning to its original pre-defined shape, to be functional as a separate entity. In accordance with the present invention, this object is accomplished with a storage container comprised of a housing that has a pair of lateral members which can both be moved between a retracted position and an extended position. When the lateral members are in the retracted position, the storage housing has the aforementioned pre-defined shape. When the lateral members are in the extended position, they are locked in the extended position, and are adapted to engage the pre-defined firearm mounting rail configuration, and are prevented from movement in the long axis of the mounting rail.

DETAILED DESCRIPTION OF THE INVENTION

Figure 1:
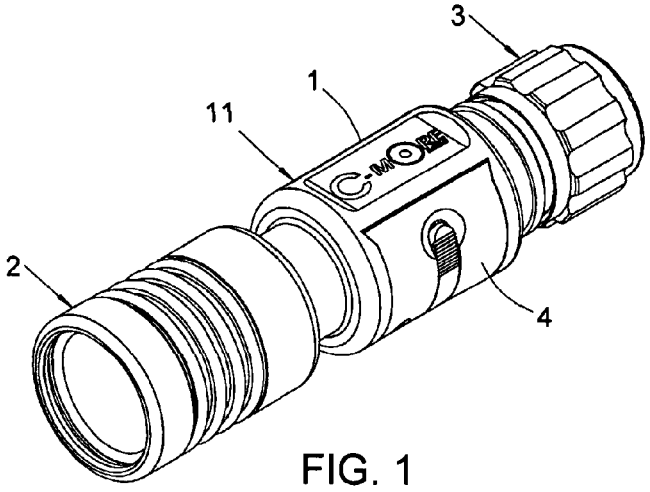
FIG. 1 is a front and top perspective of a flashlight made in accordance with the present invention.
Figure 3:
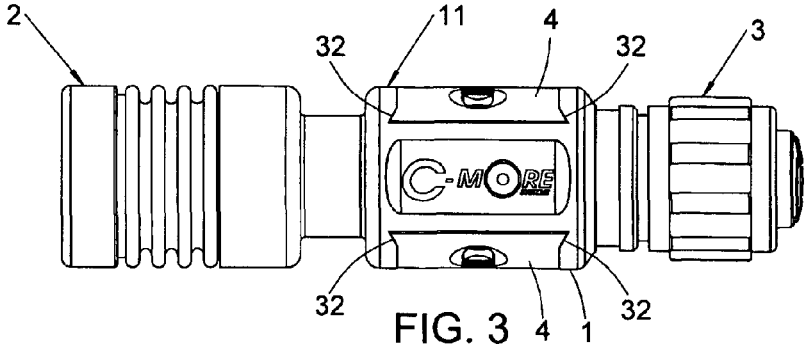
FIG. 3 is a top plan view of FIG. 1.
Figure 4:
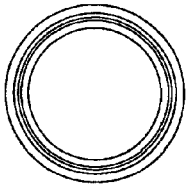
FIG. 4 is a is a front elevational of FIG. 1.
Figure 2:
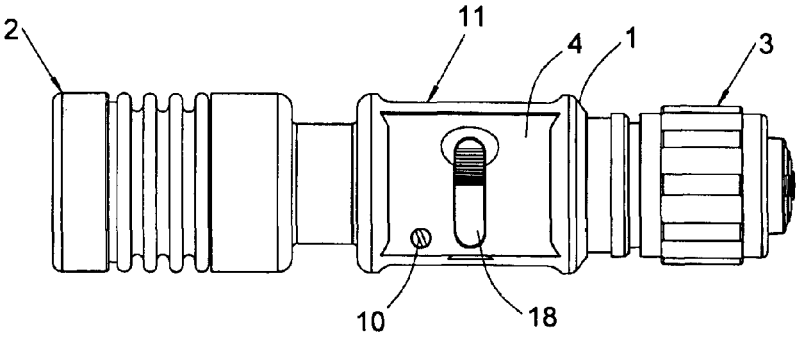
FIG. 2 is a right side elevational view of FIG. 1.
Figure 5:
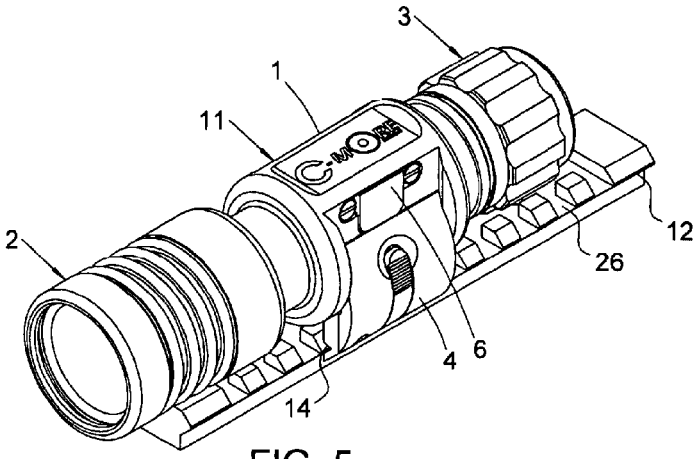
FIG. 5 is a is a perspective view of the flashlight of FIG. 1, shown attached to a mounting rail 12, which in turn is attached to the body of a firearm (not shown).
Figure 7:
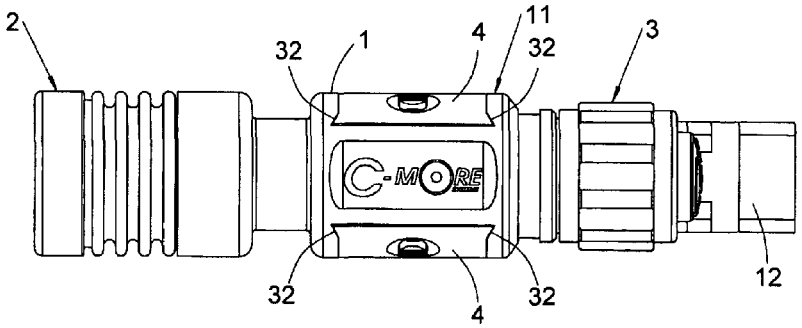
FIG. 7 is a top plan view of FIG. 5.
Figure 8:
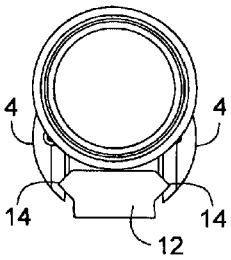
FIG. 8 is a front elevational view of FIG. 5.
Figure 6:
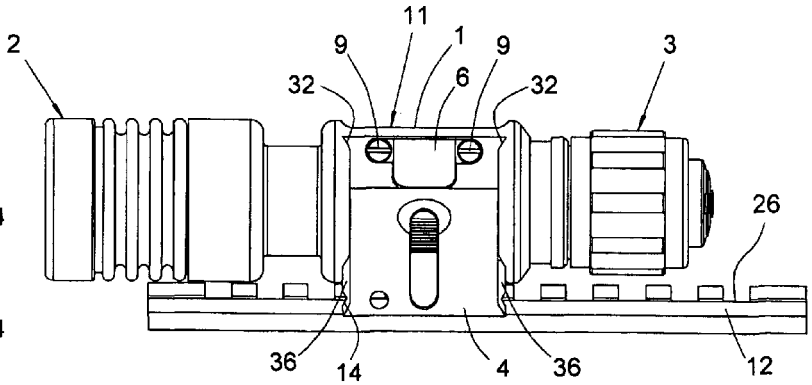
FIG. 6 is a right side elevational view of FIG. 5.
Figure 13:
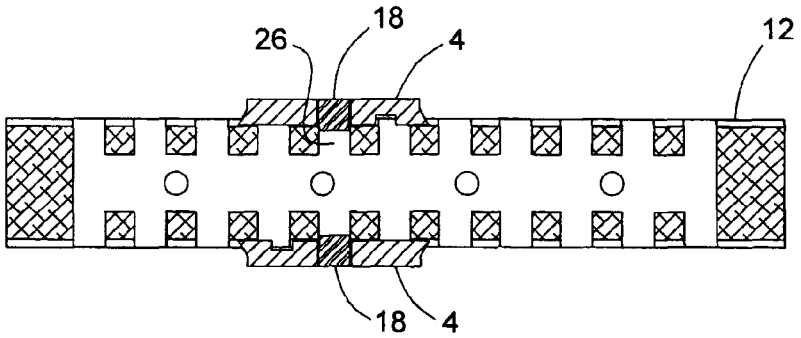
FIG. 13 is a cross-sectional view taken along line 13-13.

In the following description the housing assembly is shown configured as a flashlight and as a storage container. The description of the referenced features in the drawings that are common to both are the object of the present invention. FIGS. 1 to 4 show the housing body assembly 11, of FIG. 10 with the lens and lamp assembly 2, and the tail cap assembly 3 of FIG. 10 attached to form a flashlight that is made in accordance with the present invention. FIGS. 5, 7, and 8 show said flashlight attached to a mounting rail 12 which in turn is attached to the body of a firearm (not shown). The mounting rail 12 will have one or more mounting rail cross-slots 26 as shown in FIG. 13.

Figure 10:
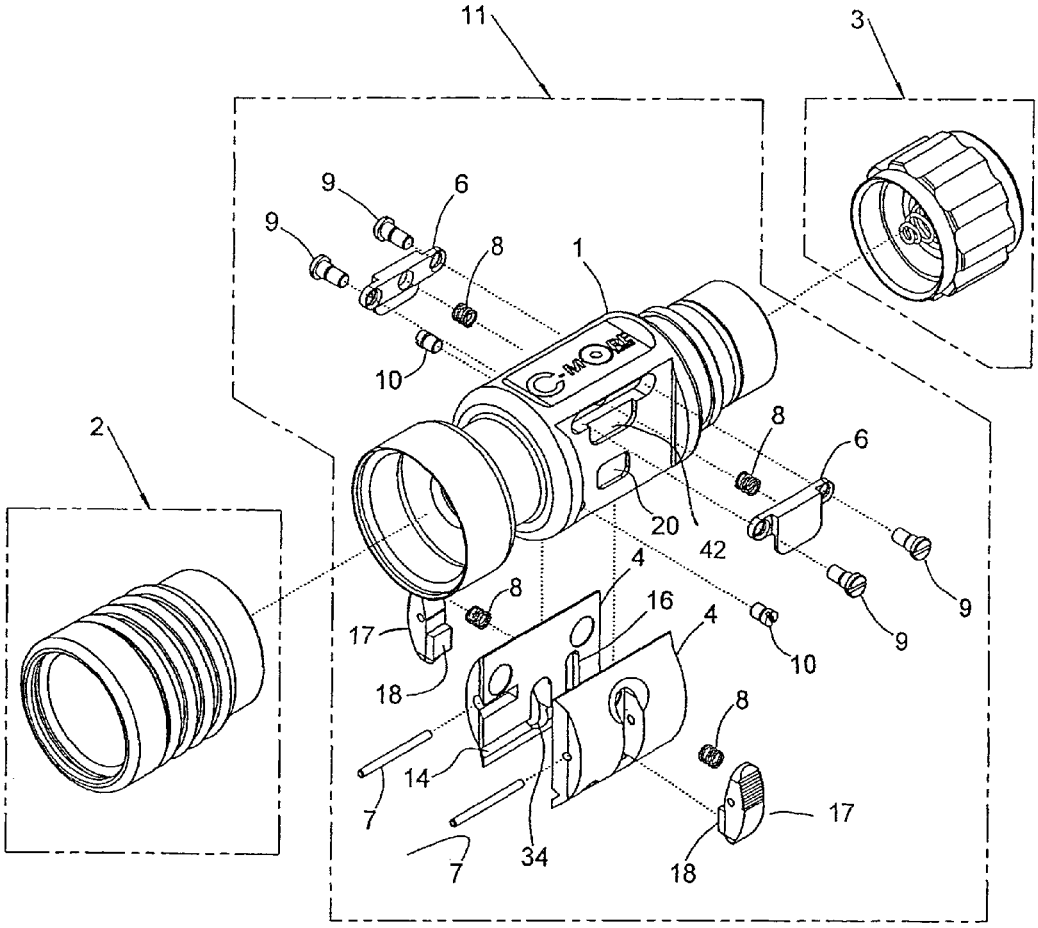
FIG. 10 is an assembly view of the flashlight of FIG. 1.

FIG. 10 shows that each side of the housing body assembly 11 is provided with a pair of rail clamping members 4 ("first" and "second" lateral members), whereby their dual angle male dovetails 36 fit within the corresponding dual angle dovetails 32 ("first" and "second" slots) of housing body 1 so that this relationship permits them to slide downwardly to grip the mounting rail 12. The clamping members 4 have a retracted position, shown in FIG. 1, and an extended position shown, for example, in FIG. 5.

Figure 14:
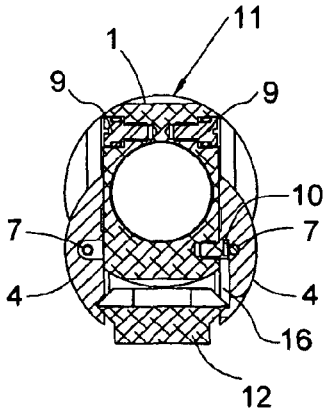
FIG. 14 is a cross-sectional view taken along line 14-14.

FIG. 10 shows stop screw slot 16 ("seventh" and "eight" slots) that encloses the projecting heads of stop screws 10 ("third" and "fourth" projections) to prevent removal of the rail clamping member 4 from the housing body 1. A cross-section taken along line 14-14 in FIG. 12 is shown in FIG. 14 which depicts the stop screw 10 with its head projecting into stop screw slot 16 within rail clamping member 4 which also provides a stop to the rail clamping members 4 when they are moved downwardly to be attached unto the mounting rail 12.

FIG. 10 also shows pivot locking foot 18 that cooperates with a correspondingly shaped housing slot 20 in housing body 1 to lock rail clamping members 4 in the retracted position. Also seen is rail clamping member window 34 wherein pivoting locking foot 18 passes as it engages housing slot 20 in housing body 1.

Figure 11A:
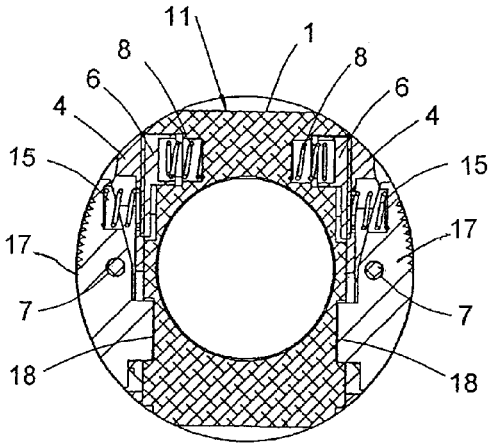
FIGS. 11A, 11B, and 11C are cross-sectional views taken through the clamp members 4.
Figure 11B:
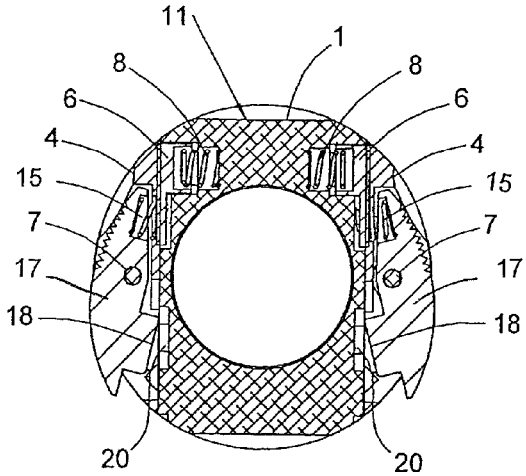
Figure 11C:
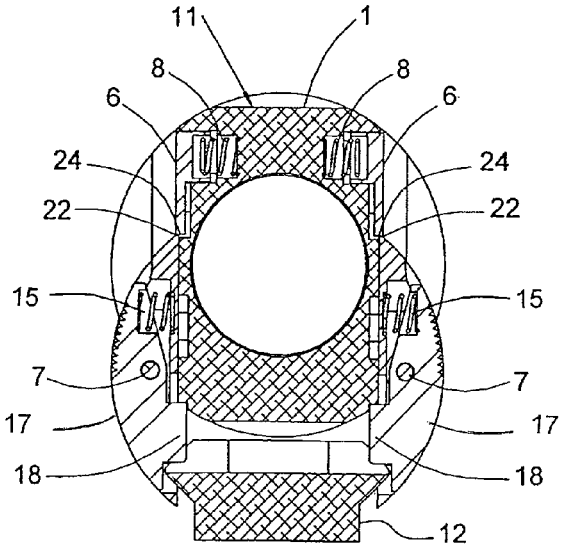

FIG. 8 shows the V-shaped grooves 14 of rail clamping members 4 that grip the correspondingly V-shaped profile of the sides of the mounting rail 12. FIGS. 11A, 11B, and 11C are cross-sectional views taken through rail clamping members 4 as they are unlocked and moved downwardly to clamp unto the mounting rail 12. When the rail clamping members are moved downwards, the pivoting members 17 ("fifth" and "sixth" lateral members) locking feet 18 ("first" and "second" projections) lock into a mounting rail cross-slot 26 in the mounting rail 12 in FIG. 11C to prevent movement of the housing body 1 along the length of mounting rail 12. FIG. 10 shows the pivot pin 7 that pivoting locking foot 18 pivots around, and spring 15 ("third" and "fourth" springs) which provides positive spring pressure for the top of the pivoting members 17 outwards from housing body 1. The locking feet 18 provide a "second" lock to prevent longitudinal movement of the housing body 1 on the mounting rail 12 when the clamping members 4 are in the extended position.

Figure 12:
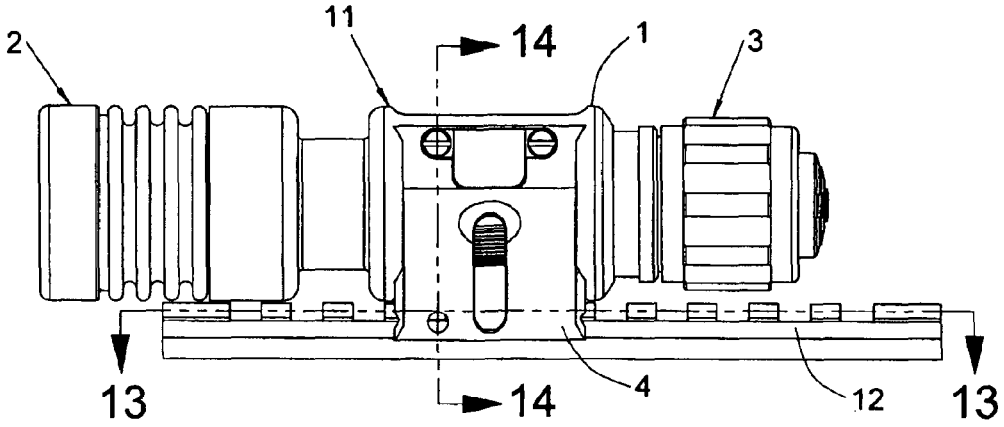
FIG. 12 is identical to FIG. 6.

A cross-sectional view taken along line 13-13 of FIG. 12 shows in FIG. 13 the locking of the housing body assembly 11 relative to the rail clamping member 4. The pivoting locking feet 18 can been seen received within a mounting rail cross-slot 26 of mounting rail 12.

FIG. 11C shows the top edges 22 of rail clamping members 4 in a locking relationship with the bottom edge 24 of the lock buttons 6 ("third" and "fourth" lateral members). The lock buttons 6 provide a "first" lock to lock the clamping members 4 in the extended position. Lock buttons 6 are under positive spring pressure away from housing body 1 by springs 8 ("first" and "second" springs). FIG. 10 shows lock button screws 9 that control the range of motion of lock buttons 6 relative to housing body 1.

FIGS. 11A-11C are cross-sectional views taken through housing body assembly 11 show the hollow interior of housing body 1.

Figure 15:
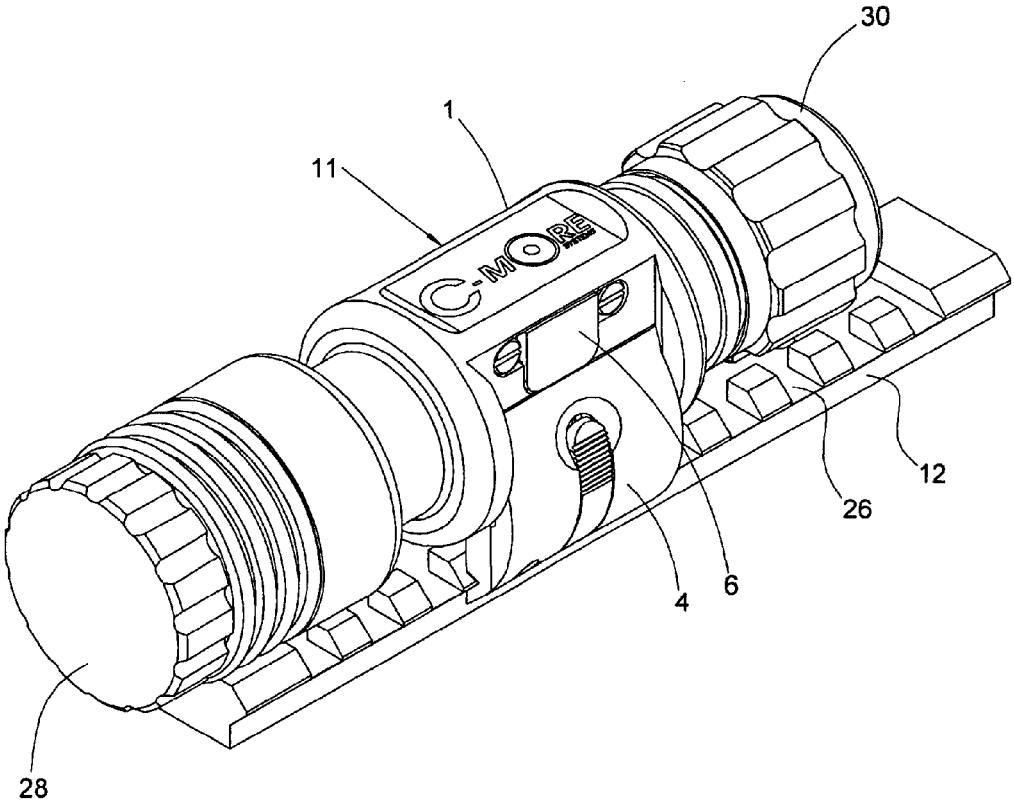
FIG. 15 is the flashlight shown in FIG. 1 where the lens and lamp assembly 2 has been replaced with a plain threaded cap and the tail cap 3 has been similarly replaced with a plain cap to allow the hollow body to be used as a storage container

FIG. 15 shows the housing body assembly 11 of FIG. 10 where the lens and lamp assembly 2 has been replaced with a removable plain head cap 28, and the tail cap assembly 3 has been replaced with a removable plain tail cap 30, to allow the hollow housing body 1 to be used as storage container that can be readily attached to a mounting rail 12. Both plain head cap 28 and plain tail cap 30 can be attached to housing body assembly 11 by a suitable means.

Figure 16:
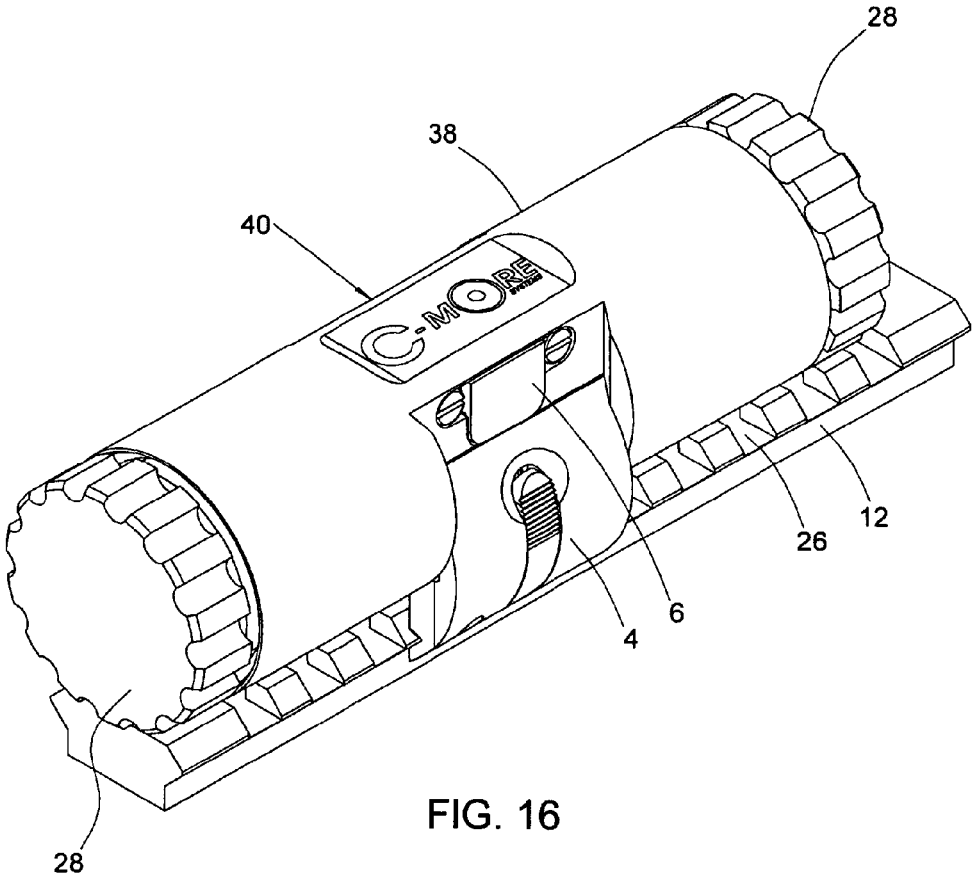
FIG. 16 is a front and top perspective of a storage container made in accordance with the present invention.

FIG. 16 shows an alternate storage container housing body 38 that is part of storage container housing body assembly 40, where plain head cap 28 can be used at both ends of storage container housing body assembly 40.

FIG. 15 shows the preferred embodiment of the present invention which provides the utilization of the housing body assembly 11 as a storage container of a pre-defined shape that can be readily attached and detached to a mounting rail 12 of the type that can be commonly found on firearms. The additional use of housing body assembly 11 as a component for an illumination device of a predefined shape is further shown in FIGS. 1-3. Reduced to practice, the hollow housing body assembly 11 would have a plain head cap 28 and a plain tail cap 30 attached by any suitable means, such as male and female threads, friction fit, or others available for any person skilled in the art. Additionally plain head cap 28 and plain tail cap 30 could be the same part, as shown in FIG. 16 which shows plain head cap 28 at both ends of storage container housing body assembly 40. Housing body assembly 11, or similarly storage container housing body assembly 40, when configured as a storage container of pre-defined shape can be utilized independent of firearm usage.

Figure 9A:
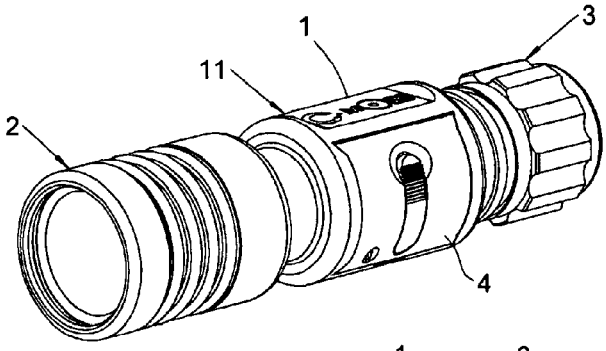
FIGS. 9A-9D is a sequence of figures showing the downward movement of the clamp members 4 for attachment of the flashlight to the rail mount 12.
Figure 9B:
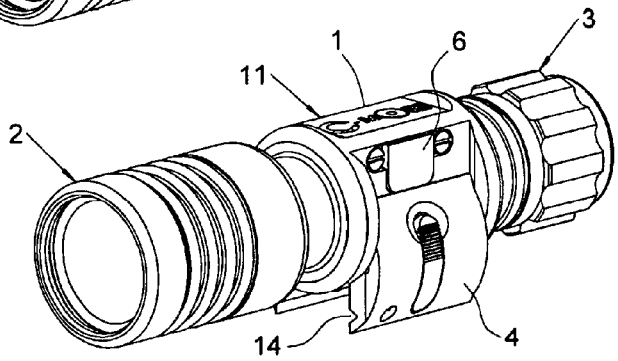

FIGS. 9A-9B show the process by which a storage container, illumination, or other device using housing body assembly 11 is transformed from a standalone device to a device that is ready to be attached to a mounting rail 12 without the use of tools or additional items. Firstly the end of the pivoting member 17 closest to the top edge of clamping member 22 shown in FIG. 11C is depressed, opposing spring pressure from springs 15 ("third" and "fourth" springs), which pivot pivoting locking feet 18 out of housing slots 20 ("fifth" and "sixth" slots) which are shown in the cross-sectional view of FIG. 20. At this juncture downwards pressure on rail clamping members 4 results in a re-configured device that has deployed the mounting rail 12 rail clamping members in a position to be attached as shown in FIG. 9B. As the rail clamping members 4 moved downwards through the dual angle dovetails 34 contained within housing body assembly 11, using their corresponding dual angle male dovetails 36, the top edges 22 of rail clamping members 4 pass below lock buttons 6 which are now not confined to housing body assembly 11, and are able to move outwards from spring pressure by springs 8 ("first" and "second" springs), as shown in FIG. 11C. The lock buttons 6 are guided by lock button screws shown in FIG. 10. When lock buttons 6 move outwards from slots 42 ("third" and "fourth" slots) in the housing body 1, their bottom edges 24 as shown in FIG. 11C are superior to the top edges 22 of rail clamping members 4, and act as a lock ("first" lock) to prevent unintentional upwards movement of rail clamping members 4.

Figure 9C:
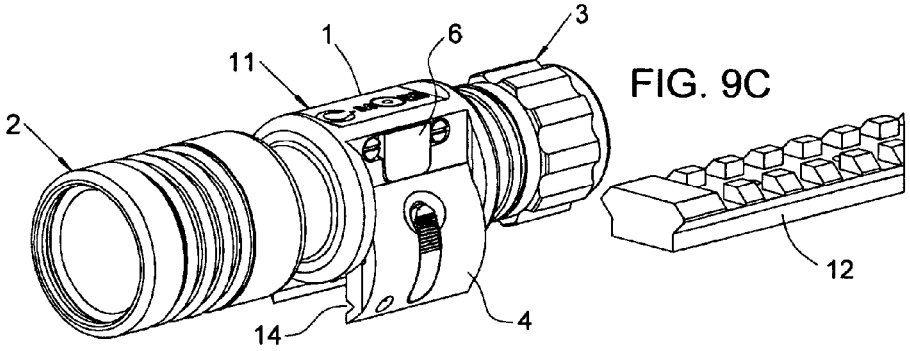
Figure 9D:
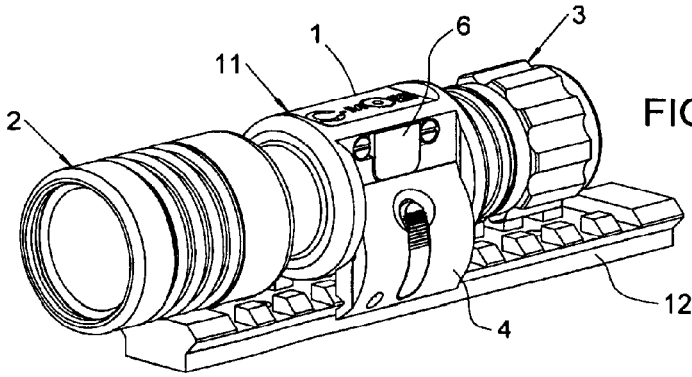

FIGS. 9C-9D show the object of the present invention in a configuration where it is about to be attached to a mounting rail 12. The ends of the pivoting members 17 that are at the end of the pivot locking feet closest to the top edges 22 of rail clamping member 4 shown in FIG. 11C are depressed opposing spring pressure from springs 15 ("third" and "fourth" springs), which pivot pivoting locking feet 18 out of the rail clamping member windows 34 of rail clamping members 4 as in FIG. 10.

With the pivoting locking feet 18 out of the rail clamping member windows 34 of the rail clamping members 4, the V-shaped grooves 14 of rail clamping members 4 of housing body assembly 11 configured as a storage container or illumination, or other device can now be slid along the correspondingly V-shaped profile of the sides of mounting rail 12 as shown in FIG. 9D. After said device is slid to the desired location along mounting rail 12, pressure is released from pivoting locking feet 18, which allows them to move inwards towards the centerline of mounting rail 12, whereby they are able to lock into a mounting rail cross-slot 26. FIG. 11 C shows pivot locking feet 18 locked into a mounting rail cross-slot 26 of mounting rail 12, locking the housing body assembly 11, relative to the length of mounting rail 12. FIG. 13 is a cross-sectional view taken along line 13-13, of FIG. 12 which shows the locking of housing body assembly 11 relative to the length of rail clamping members 4, whereby pivoting locking feet 18 are received within a mounting rail cross-slot 26 of mounting rail 12.

Removal of housing body assembly 11 when configured as a storage container, illumination, or other device from a mounting rail 12 employment as shown in FIGS. 5-8 is accomplished first, by depressing the ends of the pivoting members 17 ("fifth" and "sixth" lateral members) that are at the end of the pivot locking feet 18 closest to the top edges 22 of clamping members 4. This pivots the pivoting locking feet 18 out of the mounting rail cross-slot 26 that they have engaged, and allows the rail clamping members 4 to be slid along mounting rail 12 until they are removed from the end of the mounting rail. Once removed from mounting rail 12, housing body assembly 11 can be reconfigured to its standalone configuration by sliding the rail clamping members 4 upwards within the dual angle dovetails 32 of housing body 1. This is accomplished by depressing lock buttons 6 while applying upwards pressure to the edge of rail clamping members 4 closest to V-shaped groove 14. When rail clamping members 4 are returned moved upwards to create the pre-defined shape of the housing body assembly 11, the pivoting locking feet 18 are able to engage the housing slots 20 ("fifth" and "sixth" slots) of housing body 1, and retain the rail clamping members 4 in the standalone configuration of the storage container, illumination, or other device that housing body assembly 11 is used for. These pivoting locking feet 18 are retained within the housing slots 20 of housing body 1, by springs 15 ("third" and "fourth" springs) that apply pressure against pivoting locking feet 18. In this position, the locking feet 18 are understood to provide a "third" lock to lock the clamping members 4 in the retracted position.

When utilized as a storage container, the housing body assembly 11 in either the standalone, or attached configuration is employed in a manner similar to other storage containers, whereby either the plain head cap 28, or plain tail cap 30 are removed from the housing body 1, so that the hollow interior can be used for storage of desired items, and the cap can be replaced and removed as desired. Many means are available for the attachment of said caps to said housing, which can include threaded, friction fit, and others available to one skilled in the art.

When utilized as part of an illumination, or other device, the hollow interior of housing body assembly 11 allows the configuration of various devices that can benefit from the available internal space of housing body 1, while the device benefits from the ability to transition between a pre-defined shape, and a firearm rail attachable configuration.

Accordingly, it can be seen that the housing body assembly of this invention affords a great degree of utility, flexibility and modularity to the configuration options available to various devices that would be desirable to employ in conjunction with a firearm as well as a standalone device. There is a significant benefit from not having a dedicated storage container, or device for a firearm, that is not suitable for standalone use since its configuration is encumbered either with the appurtenances necessary to attach to a firearm mounting rail, or by being manufactured as a replacement for an existing firearm component, while providing its utility function.

Furthermore the housing body assembly of this invention has many rail attachment capabilities that are desirable such as a mechanism which can be operated with one hand if desired; and the ability to attach and detach to a mounting rail without the use of tools.

Although the description above contains many specificities, these should not be construed as limiting the scope of the invention but as merely providing illustrations of some of the presently preferred embodiments of this invention. Various other embodiments and ramifications are possible within its scope. For example, the deployable mounting configuration can be used for other devices that require a mounting mechanism that is not apparent until it is used. These devices may include storage, illumination, communication, maintenance and many others that may be apparent to those skilled in the art.

Additionally the rail clamping members can be configured to attach to mounting rails that have a profile with sides that are other than V-shaped. The transformable housing assembly readily lends itself to a multitude of devices where it may be desirable that they are attachable to a firearm, or other item that has a mounting rail.

It will be apparent to those skilled in the art that many modifications and substitutions can be made to the preferred embodiment Thus the scope of the invention should be determined by the appended claims and their legal equivalents, rather than by the examples given.

I claim:

1. A device for removable attachment to a mounting rail, said device comprising:

a) a body having lateral first and second slots having dovetail sidewalls;

b) first and second lateral members movable along respective said first and second slots between a retracted position and an extended position, said first and second lateral members having opposed dovetail edge portions that mate with respective said dovetail sidewalls;

c) said first and second lateral members when in said extended position include portions that extend beyond said body for attachment to a mounting rail;

d) a first lock to lock said first and second lateral members in said extended position;

e) a second lock to prevent longitudinal movement of said body on the mounting rail;

f) said first lock comprises third and fourth lateral members having respective bottom portions;

g) said bottom portions engage respective top edge portions of said first and second lateral members when in said extended position;

h) said third and fourth lateral members are depressible into said body when said first and second lateral members are in said retracted position;

i) said body includes third and fourth slots for receiving said third and fourth lateral members, respectively; and j) first and second springs disposed within respective said third and fourth slots to outwardly bias respective said third and fourth lateral members.

2. A device as in claim 1, and further comprising a third lock to lock said first and second lateral members in said retracted position.

3. A device as in claim 2, wherein said second lock comprises:

a) fifth and sixth lateral members carried by respective said first and second lateral members;

b) said fifth and sixth lateral members including respective first and second projections extending inwardly toward said body;

c) said first and second projections are pivotable into the mounting rail to fix said body longitudinally of the mounting rail; and d) third and fourth springs to bias respective said first and second projections into the mounting rail.

4. A device as in claim 2, wherein said third lock comprises:

a) fifth and sixth lateral members carried by respective said first and second lateral members;

b) said fifth and sixth lateral members including respective first and second projections extending inwardly toward said body;

c) said first and second projections are pivotable into respective fifth and sixth slots in said body when said first and second lateral members are in said retracted position; and d) third and fourth springs to bias respective said first and second projections into respective said fifth and sixth slots.

5. A device as in claim 1, wherein:

a) said body includes fifth and sixth slots;

b) said first and second projections are pivotable into respective said fifth and sixth slots when said first and second lateral members are in said retracted position; and c) said third and fourth springs bias respective said first and second projections into said fifth and sixth slots.

6. A device as in claim 1, wherein:

a) said first and second lateral members include respective seventh and eighth slots oriented toward said body, each of said seventh and eighth slots having a length corresponding to a distance traversed by said first and second lateral members between said retracted and extended positions; and b) said body includes third and fourth projections received within respective said seventh and eighth slots.

7. A device as in claim 1, wherein said dovetail sidewalls and said dovetail edge portions are dual-angled.

8. A device as in claim 5, wherein said third and fourth projections each includes a screw attached to said body.

9. A device as in claim 1, wherein said body includes a flashlight body.

10. A device as in claim 1, wherein said body includes a storage container.

11. A device for removable attachment to a mounting rail, said device comprising:

a) a body having lateral first and second slots having dovetail sidewalls;

b) first and second lateral members movable along respective said first and second slots between a retracted position and an extended position, said first and second lateral members having opposed dovetail edge portions that mate with respective said dovetail sidewalls;

c) said first and second lateral members when in said extended position include portions that extend beyond said body for attachment to a mounting rail;

d) a first lock to lock said first and second lateral members in said extended position;

e) a second lock to prevent longitudinal movement of said body on the mounting rail; and f) a removable cap disposed at one end of said body.

12. A device as in claim 11, wherein said body includes a storage container.

13. A device as in claim 11, wherein said body includes a flashlight body.

14. A device for removable attachment to a mounting rail, said device comprising:

a) a body having lateral first and second slots having dovetail sidewalls;

b) first and second lateral members movable along respective said first and second slots between a retracted position and an extended position, said first and second lateral members having opposed dovetail edge portions that mate with respective said dovetail sidewalls;

c) said first and second lateral members when in said extended position include portions that extend beyond said body for attachment to a mounting rail;

d) a first lock to lock said first and second lateral members in said extended position;

e) a second lock to prevent longitudinal movement of said body on the mounting rail;

f) said first and second lateral members include respective seventh and eighth slots oriented toward said body, each of said seventh and eighth slots having a length corresponding to a distance traversed by said first and second lateral members between said retracted and extended positions;

g) said body includes third and fourth projections received within respective said seventh and eighth slots; and h) said third and fourth projections each includes a screw attached to said body.

15. A device as in claim 14, wherein said body includes a flashlight body.

16. A device as in claim 14, wherein said body includes a storage container.

* * * * *